US011280112B2

(12) United States Patent
Li et al.

(10) Patent No.: US 11,280,112 B2
(45) Date of Patent: Mar. 22, 2022

(54) DUAL-UNLOCK COMBINATION LOCK

(71) Applicants: Zheng Xu, Dongguan (CN); Bo Li, Dongguan (CN)

(72) Inventors: Bo Li, Dongguan (CN); Hongliang Zhong, Dongguan (CN); Hefei Xue, Dongguan (CN); Yusha Xu, Dongguan (CN); Wentao Xu, Dongguan (CN)

(73) Assignees: Zheng Xu, Dongguan (CN); Bo Li, Dongguan (CN)

( * ) Notice: Subject to any disclaimer, the term of this patent is extended or adjusted under 35 U.S.C. 154(b) by 421 days.

(21) Appl. No.: 16/597,409

(22) Filed: Oct. 9, 2019

(65) Prior Publication Data

US 2021/0071442 A1 Mar. 11, 2021

(51) Int. Cl.
*E05B 37/02* (2006.01)

(52) U.S. Cl.
CPC ..... *E05B 37/02* (2013.01)

(58) Field of Classification Search
CPC ..... E05B 37/02
USPC ..... 70/284–286, 21, 22, 67, 68
See application file for complete search history.

(56) References Cited

U.S. PATENT DOCUMENTS 6,598,434 B2 * 7/2003 Yang ..... E05B 37/02 70/213
8,020,415 B2 * 9/2011 Corbin ..... B65D 55/145 70/63
10,392,835 B2 * 8/2019 Ramakrishna ..... E05B 67/003
10,513,871 B2 * 12/2019 Wang ..... E05B 19/0005
11,131,119 B2 * 9/2021 Hwang ..... E05B 37/0031
11,220,243 B1 * 1/2022 Bell ..... B60S 5/00
2004/0011098 A1 * 1/2004 Yang ..... E05B 37/0031 70/284
2006/0162399 A1 * 7/2006 Yu ..... E05B 37/02 70/21
2006/0254329 A1 * 11/2006 Yu ..... E05B 37/02 70/284
2007/0214850 A1 * 9/2007 Ma ..... E05B 37/0034 70/284

(Continued)

FOREIGN PATENT DOCUMENTS

CN 110230439 A * 9/2019
CN 209413489 U * 9/2019 ..... A44B 19/30

(Continued)

*Primary Examiner* — Suzanne L Barrett
(74) *Attorney, Agent, or Firm* — Wang Law Firm, Inc.

(57) ABSTRACT

A dual-unlock combination lock provides a first set of correct password and a second set of correct password to be used independently. After a password switch pushbutton is operated to drive a bracket to a corresponding position, a corresponding correct password is input into a combination wheel, so that an elastic member props the bracket to release from a transmission element in order to unlock the combination lock. One password element can achieve the effect of unlocking the lock by using two sets of correct password independently to provide a broader scope of applicability. The first set of correct password with the setting and use similar to those of a common password is provided for ordinary users, and the second set of correct password is a fixed code provided for designated users to unlock the combination lock by scanning an identification code by a mobile terminal.

9 Claims, 5 Drawing Sheets

(56) References Cited

U.S. PATENT DOCUMENTS

| | | | | |
|---|---|---|---|---|
| 2010/0000276 | A1* | 1/2010 | Ng | E05B 37/025 70/291 |
| 2010/0307208 | A1* | 12/2010 | Corbin | B65D 55/145 70/158 |
| 2011/0041574 | A1* | 2/2011 | Yang | E05B 37/02 70/315 |
| 2017/0306650 | A1* | 10/2017 | Lai | E05B 37/0034 |
| 2021/0396042 | A1* | 12/2021 | Lin | E05B 37/02 |

FOREIGN PATENT DOCUMENTS

| | | | | | |
|---|---|---|---|---|---|
| CN | 111173375 | A | * | 5/2020 | |
| CN | 112431484 | A | * | 3/2021 | |
| GB | 2439455 | A | * | 12/2007 | E05B 37/02 |
| WO | WO-2019036837 | A1 | * | 2/2019 | E05B 37/02 |

* cited by examiner

DUAL-UNLOCK COMBINATION LOCK

FIELD OF INVENTION

The present invention relates to the field of locks, in particular to a dual-unlock combination lock.

BACKGROUND OF INVENTION

In general, a combination lock sets a password element provided for users to turn a combination wheel to a correct password position of the password element in order to open the combination lock without requiring any key and change the unlock number anytime conveniently, and such application is not just convenient only, but also highly secured and safe. The password element of a conventional combination lock can be used to open the lock by a set of password, provided that the password has not been reset. If a user forgets the password, then the user will be unable to open the combination lock or use the lock anymore. Therefore, the combination lock of this sort cannot meet the using requirements of certain special situations. For example, if an object to be locked is managed independently by two administrators (in other words, one lock is used independently by two persons) and one of the administrators resets the password, and if the other administrator does not know the new password, then the other administration will be unable to open the lock. Therefore, locks using both of the password element and a key-cylinder for the unlock functions are commercially available in the market, but the key-cylinder has a low security performance.

SUMMARY OF THE INVENTION

In view of the aforementioned drawbacks of the prior art, it is a primary objective of the present invention to provide a dual-unlock combination lock capable of opening the combination lock by two sets of password of one password element.

To achieve the aforementioned and other objectives, the present invention discloses a dual-unlock combination lock comprising a lock housing, a password element, a transmission element and a lock tongue for locking an object, wherein the password element comprises a bracket, a center rod, and two or more combination wheels, and each combination wheel has an inner sleeve, and each combination wheel and each corresponding inner sleeve are rotated altogether, and the center rod passes through the inner sleeve; the bracket has an elastic member installed at the bottom thereof, such that after the combination wheel inputs a correct password, and the elastic member props the bracket to release from the transmission element; the bracket has a bump formed at the top thereof, and the combination wheel has a first alignment slot, so that when the bump is aligned precisely with and embedded into the first alignment slot, a first set of correct password is defined; the inner sleeve has a second alignment slot, and the dual-unlock combination lock further comprises a password switch pushbutton operated for driving the bump of the bracket to align precisely with the inner sleeve, and when the bump is aligned precisely with and embedded into the second alignment slot, a second set of correct password is defined.

In a preferred embodiment of the dual-unlock combination lock of the present invention, the dual-unlock combination lock has an identification code, and a mobile terminal reads and sends the information of the identification code to a processor, and the processor outputs the second set of correct password to the mobile terminal according to the received information.

In a preferred embodiment of the dual-unlock combination lock of the present invention, the password switch pushbutton has a tilted pressing portion, and the bracket has a tilted force receiving portion, and the pressing portion presses the force receiving portion to drive the bracket to move transversally.

In a preferred embodiment of the dual-unlock combination lock of the present invention, the elastic member comprises a lifting block and a support spring, and the lifting block props the bracket, and the support spring props the lifting block, and the lifting block has a limit portion for propping the transmission element, and after the combination wheel inputs a correct password, the support spring pushes the lifting block and the bracket to move upward, so that the limit portion and the driving module are staggered to unlock the combination lock.

In a preferred embodiment of the dual-unlock combination lock of the present invention, the bracket has a rotary shaft disposed on a side thereof and hinged to the lock housing, and the lifting block props the other side of the bracket, and a restoring spring is sheathed on the rotary shaft for applying a transverse resilience to the bracket.

In a preferred embodiment of the dual-unlock combination lock of the present invention, the driving module comprises a drive plate and an unlock pushbutton, and the drive plate has an end propping the lock tongue and the other end limited by the lifting block, and after the combination wheel inputs a correct password, the unlock pushbutton is capable of driving the drive plate to move and unlock the combination lock, and the driving module further comprises a restoring spring for applying a force to the drive plate in a direction towards the lock tongue.

In a preferred embodiment of the dual-unlock combination lock of the present invention, the dual-unlock combination lock further comprises a guide stop block and a limit spring, and the stop block and the lifting block are configured to be corresponsive to each other through a bevel, and the guide stop block elastically presses the lifting block through the limit spring.

In a preferred embodiment of the dual-unlock combination lock of the present invention, the dual-unlock combination lock further comprises a fixed press block fixed to the lock housing, and the bracket is installed on the fixed press block, and the drive plate passes through the fixed press block in a fixed direction, and the lifting block is embedded into the fixed press block.

In a preferred embodiment of the dual-unlock combination lock of the present invention, the lock housing comprises a lock chassis and a shell body that form an inner cavity, and the lock chassis and the shell body are fixed and coupled with each other by a screw.

The present invention has the following advantageous effects:

Compared with the prior art, the dual-unlock combination lock of the present invention comprises the bump formed at the top of the bracket, the combination wheel having the first alignment slot, and the inner sleeve having the second alignment slot, so that when the bump is aligned precisely with and embedded into the first alignment slot, the first set of correct password is defined, and when the bump is aligned precisely with and embedded into the second alignment slot, the second set of correct password is defined, and the password switch pushbutton can be operated to drive the bump of the bracket to align with the inner sleeve or the combination wheel. In an application, the first set of correct password and the second set of correct password can be used independently. After a password switch pushbutton is operated to drive a bracket to a corresponding position, a corresponding correct password is input into a combination wheel, so that an elastic member props the bracket to release from a transmission element in order to unlock the combination lock. One password element can achieve the effect of unlocking the lock by using two sets of correct password independently to provide a broader scope of applicability.

Wherein, the first set of correct password with the setting and use similar to those of a common password is provided for ordinary users, and the second set of correct password is a fixed code provided for designated users to unlock the combination lock by scanning an identification code by a mobile terminal to achieve the effects of maintaining and unlocking the lock at a remote, providing a backstage management, and overcoming the drawbacks of the conventional lock cylinder operating with password and the unsecured safety performance.

The present invention will become clearer in light of the following detailed description of an illustrative embodiment of this invention described in connection with the drawings, so that people having ordinary skill in the art can implement the present invention according to the description of this specification.

BRIEF DESCRIPTION OF NUMERALS IN THE DRAWINGS

1: Lock housing; 11: Lock chassis; 12: Shell body; 2: Password element; 21: Bracket; 211: Rotary shaft; 212: Beam; 213: Protrusion; 214: Force receiving portion; 22: Restoring spring; 23: Center rod 24: Combination wheel; 241: Annular projection; 2411: First alignment slot; 25: Inner sleeve; 251: Second alignment slot; 3: Elastic member; 31: Lifting block; 311: Limit portion; 32: Support spring; 4: Driving module; 41: Drive plate; 42: Unlock pushbutton; 43: Restoring spring; 5: Lock tongue; 6: Password switch pushbutton; 61: Pressing portion; 7: Fixed press block; 8: Guide stop block; 9: Limit spring.

DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
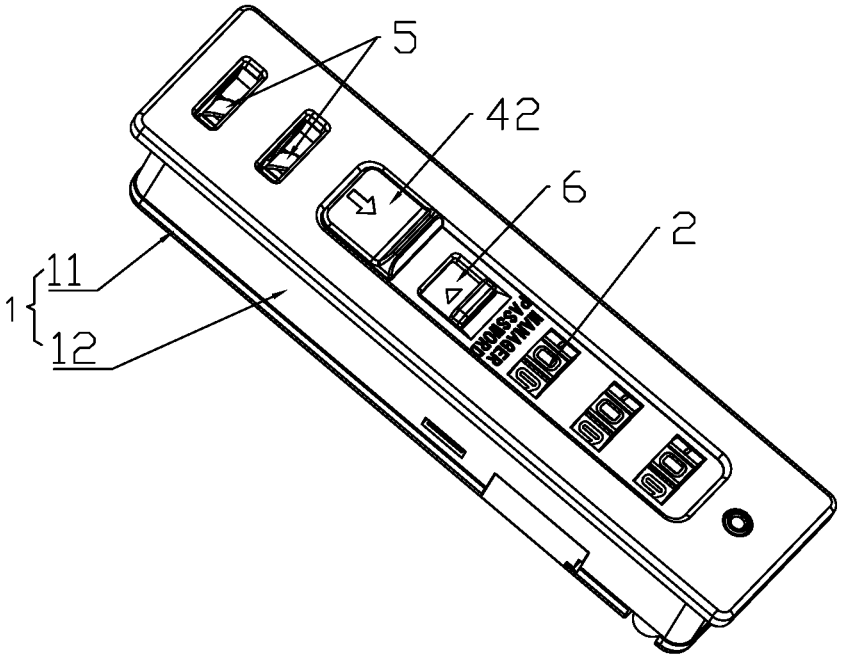
FIG. 1 is a perspective view of a combination lock in accordance with an embodiment of the present invention.
Figure 2:
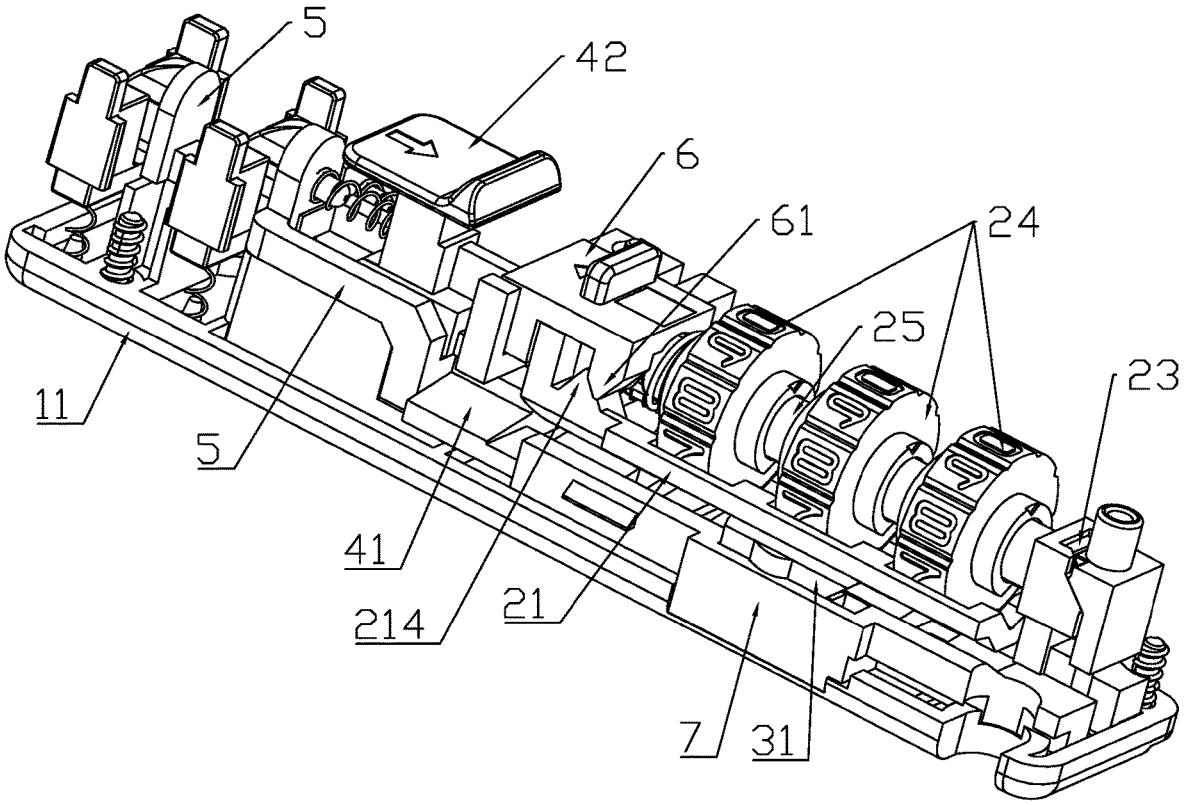
FIG. 2 is a perspective view showing a combination lock in accordance with an embodiment of the present invention after a shell body is hidden.
Figure 3:
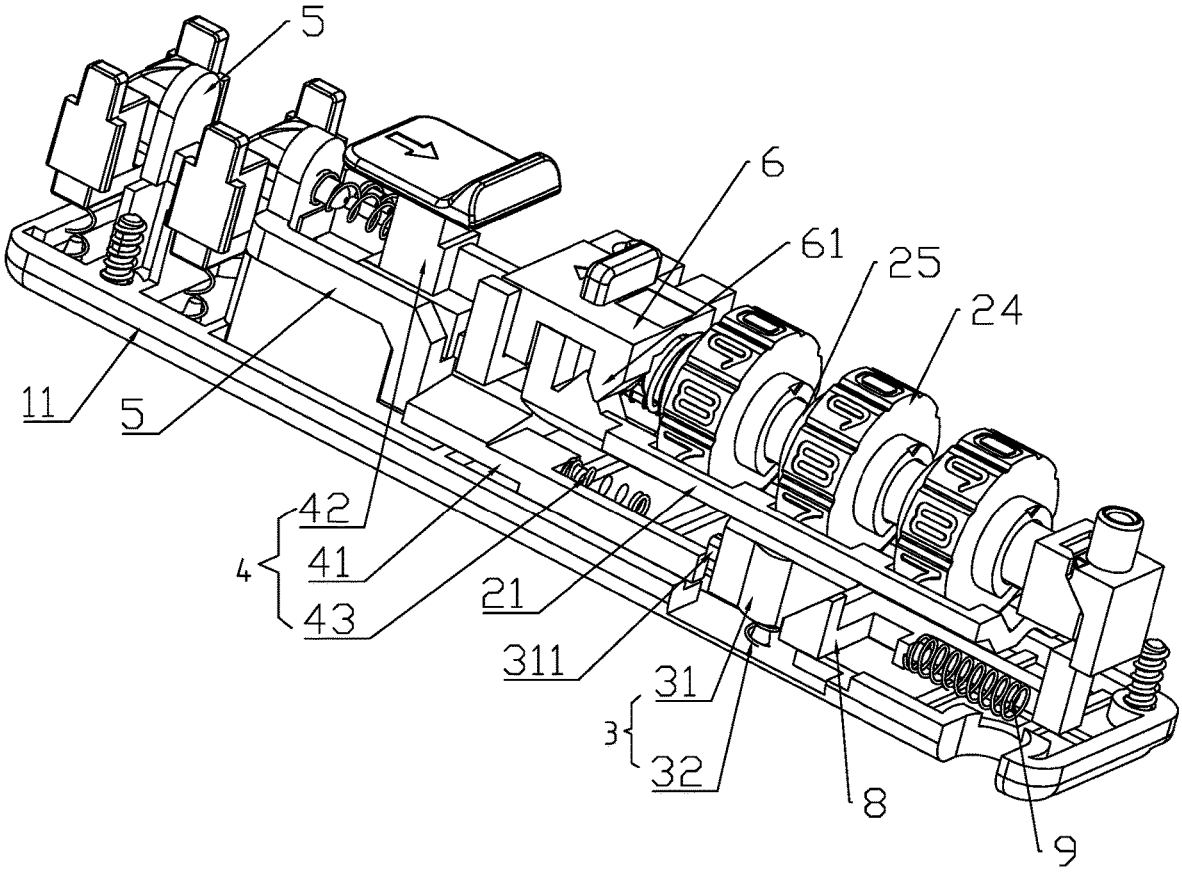
FIG. 3 is a perspective view showing the combination lock of FIG. 2 after a fixed press block is hidden.
Figure 4:
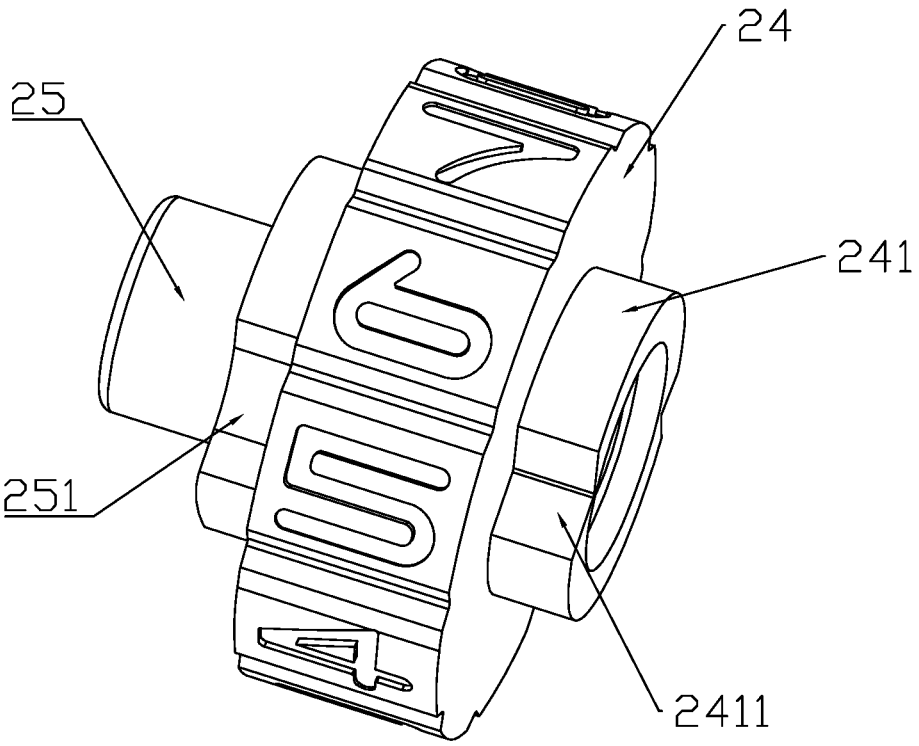
FIG. 4 is a perspective view of a combination wheel and a corresponding inner sleeve in accordance with an embodiment of the present invention.
Figure 5:
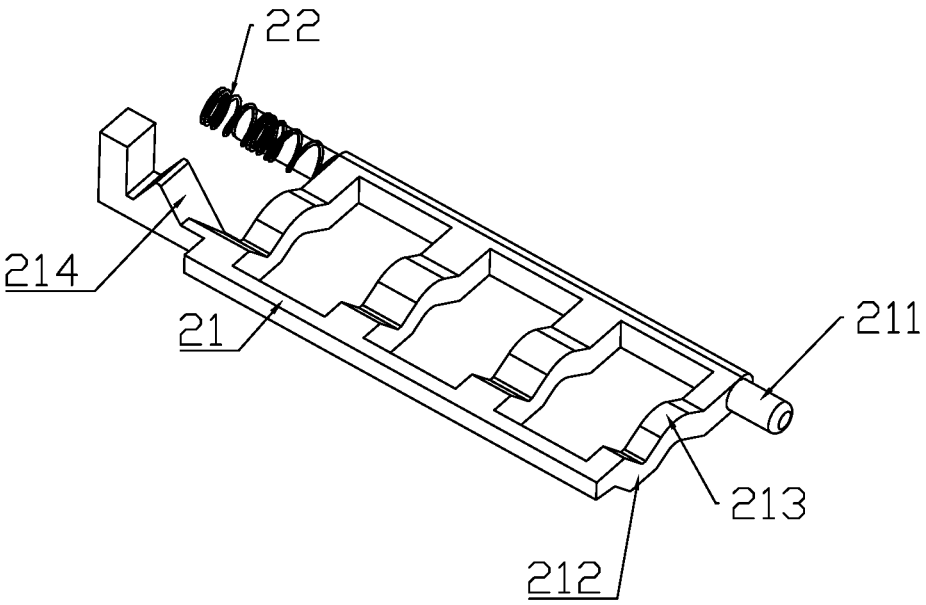
FIG. 5 is a perspective view of a bracket in accordance with an embodiment of the present invention.

With reference to FIGS. 1 to 5 for a dual-unlock combination lock in accordance with an embodiment of the present invention, the dual-unlock combination lock comprises a lock housing 1, a password element 2, a transmission element 4 and two lock tongues 5 for locking an object, wherein the lock housing 1 comprises a lock chassis 11 and a shell body 12 that form an inner cavity, and the lock chassis 11 and the shell body 12 are fixed and coupled to each other by a screw, and the lock tongue 5, the transmission element 4 and the password element 2 are installed in the lock housing 1, and the lock tongue 5 is controlled by the transmission element 4, and the transmission element 4 is controlled by the password element 2 to lock and unlock the combination lock. Specifically, the password element 2 comprises a bracket 21, a center rod 23, and three combination wheels 24, and the combination wheel 24 is partially exposed from the lock housing 1 and provided for users to input a correct password. Each combination wheel 24 has an inner sleeve 25 jointly rotated with the combination wheel 24, and the center rod 23 is movably passed through the inner sleeve 25, and the center rod 23 is just used for connecting the three inner sleeves 25 together, but it has no locking or unlocking effect. The bracket 21 has a rotary shaft 211 installed on a side thereof and hinged to the lock housing 1, and a restoring spring 22 is sheathed on the rotary shaft 211 and provided for applying a transverse resilience to the bracket 21. The bracket 21 has an elastic member 3 installed at the bottom of the other side of the bracket 21. After the combination wheel 24 inputs a correct password, the elastic member 3 props the bracket 21 to release from the driving module 4. The bracket 21 has four beams 212, and the top of each beam 212 has a V-shaped bump 213, and the combination wheel 24 has an annular projection 241 disposed on a side thereof, and the annular projection 241 has a V-shaped first alignment slot 2411 formed on an outer side thereof. When the bump 213 is aligned precisely with and embedded into the first alignment slot 2411, a first set of correct password is defined. The inner sleeve 25 has a V-shaped second alignment slot 251, and the dual-unlock combination lock further comprises a password switch pushbutton 6 provided for driving the bump 213 of the bracket 21 to align with the inner sleeve 25, and when the bump 213 is aligned precisely and embedded into the second alignment slot 251, a second set of correct password is defined.

In an application, the first set of correct password and the second set of correct password can be used independently, and when it is necessary to use the first set of correct password to unlock the combination lock, the password switch pushbutton 6 is operated to drive the bump 213 of the bracket 21 to align with the annular projection 241 of the combination wheel 24, and the combination wheel 24 is rotated to the first set of correct password, so that the bump 213 of the bracket 21 is aligned precisely with and embedded into the alignment slot 2411, and the bracket 21 is moved upward to give space for the elastic member 3 to release from the transmission element 4 in order to unlock the combination lock. When it is necessary to use the second set of correct password to unlock the combination lock, the password switch pushbutton 6 is operated to drive the bump 213 of the bracket 21 to align with the inner sleeve 25, and the combination wheel 24 is rotated to the second set of correct password, so that the bump 213 of the bracket 21 is aligned precisely with and embedded into the second alignment slot 251 of the inner sleeve 25. Similarly, the elastic member 3 props the bracket 21 to release from the driving module 4, and the lock tongue 5 and driving module 4 can be moved to the right to unlock the combination lock automatically. In summation, the combination lock of this embodiment can use one password element 2 to achieve the effect to unlocking the combination lock by using two sets of correct password independently, so as to provide a broader scope of applicability. For example, if an object to be locked is managed independently by two administrators, wherein one lock is used by both administrators independently, and they can set and manage the password independently.

Specifically, the password switch pushbutton 6 has a two-dimensional code, and the second set of correct password can be obtained by scanning the two-dimensional code only. If the user forgets the first set of correct password, the user can obtain the second set of correct password by a processor by scanning the two-dimensional code. In a special environment, such as passing through customs, the two-dimensional code may be scanned to obtain the password for unlocking to facilitate opening the lock. In action, the two-dimensional code may be replaced by any other identification code such as a barcode or an electronic tag, and the mobile terminal reads and sends the information of the identification code to a processor, and the processor outputs the second set of correct password to a mobile terminal according to the received information. Wherein, the first set of correct password is provided for ordinary users, and the setting and use of the first set of correct password are similar to those of a common password, and the second set of correct password is a fixed code provided for designated users to unlock the combination lock by scanning an identification code by a mobile terminal, to achieve the effects of maintaining and unlocking the lock at a remote, providing a backstage management, and overcoming the drawbacks of the conventional lock cylinder operating with password and the unsecured safety performance.

Specifically, the password switch pushbutton 6 has a tilted V-shaped pressing portion 61, and the bracket 21 has a tilted V-shaped force receiving portion 214, and the pressing portion 61 presses the force receiving portion 214. If the password switch pushbutton 6 is operated to drive the bracket 21 to move transversely to the left and the bracket 21 is transversely engaged by the combination wheel 24 or the inner sleeve 25, the password switch pushbutton 6 will keep applying a force to the left of the force receiving portion 214 of the bracket 21, so as to drive the bracket 21 to move downward and avoid the bracket 21 from being stuck transversely, and assure a smooth switch of the password.

Specifically, the elastic member 3 comprises a lifting block 31 and a support spring 32, and the lifting block 31 props the bottom side of the bracket 21, and the support spring 32 props the lifting block 31, and the lifting block 31 has a limit portion 311 propping the driving module 4. After the combination wheel 24 inputs a correct password, the support spring 32 pushes the lifting block 31 and the bracket 21 to move upward, so that the limit portion 311 and the driving module 4 are staggered with each other to unlock the combination lock.

Specifically, the driving module 4 comprises a drive plate 41 and an unlock pushbutton 42, and the drive plate 41 has an end propping the lock tongue 5 and the other end limited by the lifting block 31. After the combination wheel 24 inputs a correct password, the unlock pushbutton 42 drives the drive plate 41 to move to unlock the combination lock. The driving module 4 further comprises a restoring spring 43 for applying a force to the drive plate 41 in a direction towards the lock tongue 5. After the unlock pushbutton 42 is released, the lock tongue 5 can restore its original position.

Specifically, the combination lock further comprises a guide stop block 8 and a limit spring 9, and the stop block and the lifting block 31 are configured to be corresponsive to each other through a bevel, and the guide stop block 8 elastically presses the lifting block 31 through the limit spring 9 for the effect of assisting the lifting block 31 to move vertically up and down, but not transversely.

Specifically, the dual-unlock combination lock further comprises a fixed press block 7 fixed to the lock housing 1, and the bracket is installed on the fixed press block 7, and the drive plate 41 passes through the fixed press block 7 in a fixed direction, and the lifting block 31 is embedded into the fixed press block 7 to facilitate assembling and providing a compact structure.

While the invention has been described by means of specific embodiments, numerous modifications and variations could be made thereto by those skilled in the art without departing from the scope and spirit of the invention set forth in the claims.

What is claimed is:

1. A dual-unlock combination lock, comprising a lock housing, a password element, a transmission element, and a lock tongue for locking an object, and the lock tongue, the transmission element and the password element being installed in the lock housing, and the lock tongue being controlled by the transmission element, and the transmission element being controlled by the password element for locking and unlocking the combination lock, wherein the password element comprises a bracket, a center rod, and two or more combination wheels, and each combination wheel has an inner sleeve, and each combination wheel and each corresponding inner sleeve are rotated altogether, and the center rod passes through the inner sleeve; the bracket has an elastic member installed at the bottom thereof, such that after the combination wheel inputs a correct password, the elastic member props the bracket to release from the transmission element; the bracket has a bump formed at the top thereof, and the combination wheel has a first alignment slot, so that when the bump is aligned precisely with and embedded into the first alignment slot, a first set of correct password is defined; the inner sleeve has a second alignment slot, and the dual-unlock combination lock further comprises a password switch pushbutton operated for driving the bump of the bracket to align precisely with the inner sleeve, and when the bump is aligned precisely with and embedded into the second alignment slot, a second set of correct password is defined.

2. The dual-unlock combination lock as claimed in claim 1, wherein the dual-unlock combination lock has an identification code, and a mobile terminal reads and sends the information of the identification code to a processor, and the processor outputs the second set of correct password to the mobile terminal according to the received information.

3. The dual-unlock combination lock as claimed in claim 1, wherein the password switch pushbutton has a tilted pressing portion, and the bracket has a tilted force receiving portion, and the pressing portion presses the force receiving portion to drive the bracket to move transversally.

4. The dual-unlock combination lock as claimed in claim 1, wherein the elastic member comprises a lifting block and a support spring, and the lifting block props the bracket, and the support spring props the lifting block, and the lifting block has a limit portion for propping the transmission element, and after the combination wheel inputs a correct password, the support spring pushes the lifting block and the bracket to move upward, so that the limit portion and the driving module are staggered to unlock the combination lock.

5. The dual-unlock combination lock as claimed in claim 4, wherein the bracket has a rotary shaft disposed on a side thereof and hinged to the lock housing, and the lifting block props the other side of the bracket, and a restoring spring is sheathed on the rotary shaft for applying a transverse resilience to the bracket.

6. The dual-unlock combination lock as claimed in claim 4, wherein the driving module comprises a drive plate and an unlock pushbutton, and the drive plate has an end propping the lock tongue and the other end limited by the lifting block, and after the combination wheel inputs a correct password, the unlock pushbutton is capable of driving the drive plate to move and unlock the combination lock, and the driving module further comprises a restoring spring for applying a force to the drive plate in a direction towards the lock tongue.

7. The dual-unlock combination lock as claimed in claim 6, wherein the dual-unlock combination lock further comprises a guide stop block and a limit spring, and the stop block and the lifting block are configured to be corresponsive to each other through a bevel, and the guide stop block elastically presses the lifting block through the limit spring.

8. The dual-unlock combination lock as claimed in claim 6, wherein the dual-unlock combination lock further comprises a fixed press block fixed to the lock housing, and the bracket is installed on the fixed press block, and the drive plate passes through the fixed press block in a fixed direction, and the lifting block is embedded into the fixed press block.

9. The dual-unlock combination lock as claimed in claim 1, wherein the lock housing comprises a lock chassis and a shell body that form an inner cavity, and the lock chassis and the shell body are fixed and coupled with each other by a screw.

* * * * *